United States Patent [19]

Rakestraw

[11] 3,946,794

[45] Mar. 30, 1976

[54] METHOD FOR PRODUCING FINE DIAMETER WIRE FROM STEEL-TITANIUM MELTS

[75] Inventor: Lawrence F. Rakestraw, Raleigh, N.C.

[73] Assignee: Monsanto Company, St. Louis, Mo.

[22] Filed: Aug. 29, 1973

[21] Appl. No.: 392,601

[52] U.S. Cl. ..... 164/82; 164/281

[51] Int. Cl. ..... B22d 11/10

[58] Field of Search ..... 164/66, 82, 89; 264/176 F

[56] References Cited

UNITED STATES PATENTS

| | | | |
|---|---|---|---|
| 2,907,082 | 10/1959 | Pond | 164/66 |
| 3,216,076 | 11/1965 | Alber et al. | 164/82 X |
| 3,658,979 | 4/1972 | Dunn et al. | 164/66 X |
| 3,692,089 | 9/1972 | Privett et al. | 164/66 |

*Primary Examiner*—R. Spencer Annear

*Attorney, Agent, or Firm*—Russell E. Weinkauf

[57] ABSTRACT

A method is provided for preventing orifice plugging when melt extruding a steel-titanium alloy to form fine diameter wire. This is accomplished by controlling the oxygen potential in the melt above the orifice at a level wherein the activity of titania within the melt is maintained at from 0.3 to unity — the standard state of unit activity being defined as the melt saturated in titania at the concentrations of titanium and oxygen therein and at the melt temperature.

8 Claims, 1 Drawing Figure

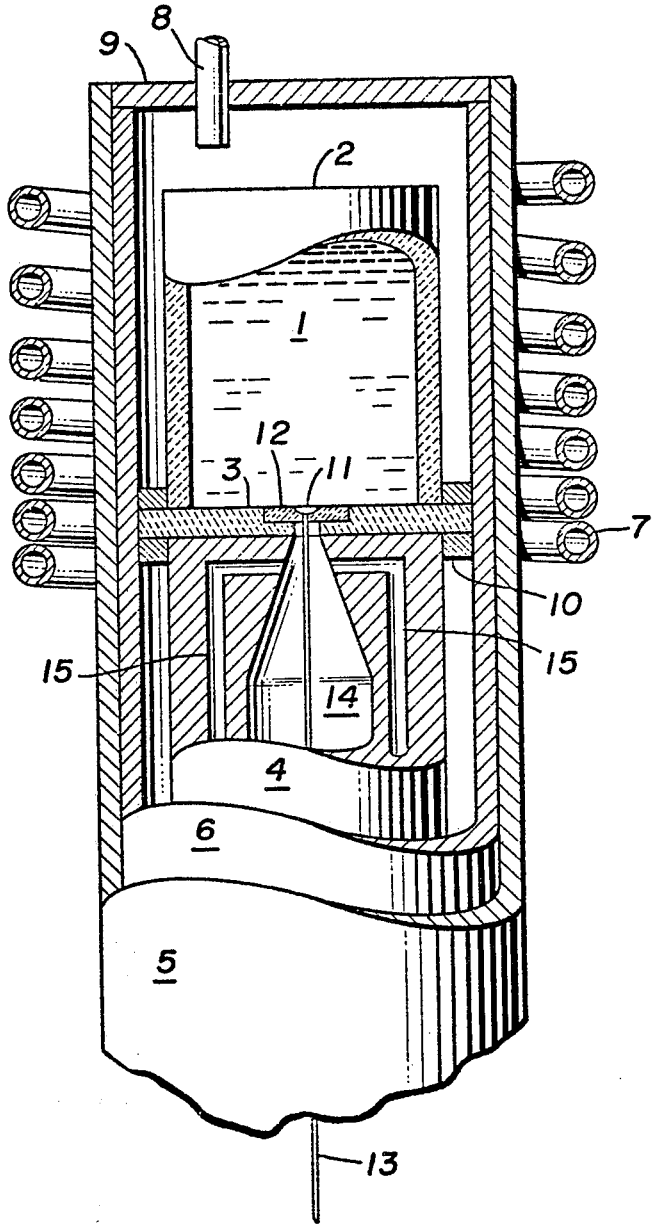
8
9
2
1
12
3
11
7
10
15
15
14
4
6
5
13

METHOD FOR PRODUCING FINE DIAMETER WIRE FROM STEEL-TITANIUM MELTS

BACKGROUND OF THE INVENTION

This invention relates to improvements in the method wherein steel alloys are melt extruded to produce fine diameter wire.

Until quite recently, it was not possible to fabricate filamentary structures from metals or metal alloys by the method of melt extrusion. The limiting factor was that the melt viscosity of these materials is so low as to be practically negligible. In other words, the melts of metals and metal alloys are essentially inviscid.

The problem presented by an inviscid melt when attempting to extrude it to form filaments is that the surface tension of the filamentary jet, as it issues from the shaping die, is so great in relation to its viscosity that the molten stream breaks up before sufficient heat can be transferred for conversion to the solid state.

This intractable problem has now yielded to a unique solution as described in U.S. Pat. Nos. 3,216,076 and 3,658,979. In accordance therewith, the nascent molten jet, as it issues from the shaping die, is brought into contact with a gas capable of instant reaction with the jet surface. The result is the formation of a thin film which envelopes the jet surface. This thin film has been found to be capable of holding the jet stream together until sufficient heat can be transferred to effect solidification. For example, fine diameter wire may be formed from aluminum by extruding the melt at an appropriate velocity into an oxygen medium. When the hot jet issuing from the extrusion orifice contacts the oxygen-containing atmosphere, a stable film of melt insoluble aluminum oxide forms almost instantaneously about the peripheral surface of the jet. In essence, a sheath is formed which protects the filamentary jet or stream against surface tension break-up until solidification takes place.

The oxide of aluminum is a solid which is insoluble in the non-oxidized molten metal. This, of course makes film formation by contact with oxygen below the orifice possible. However, in the instance of ferrous metals, as for example steel, the iron oxide is soluble in the liquid melt. Consequently, a film will not form when a molten jet is extruded into an oxidizing atmosphere.

A solution to this problem is provided in the teachings of U.S. Pat. No. 3,216,076. As disclosed therein, filamentary structures may be formed from metals whose oxides are soluble in the non-oxidized molten metal by alloying them with a minor percentage of a compatible metal whose oxide is insoluble in the non-oxidized molten metal. By compatible metal there is meant a metal or combination of metals having the ability to form an alloy. According to U.S. Pat. No. 3,216,076 metals which may be used for this purpose include aluminum, magnesium, beryllium, chromium, lanthanum and combinations thereof. The particular metal employed is generally present in amounts in excess of 0.5% by weight of the alloy. The upper limit on the quantity of metal which will produce a stable oxide is only determined by the physical characteristics desired in the ultimate filamentary product. The metal most commonly alloyed with steel for effecting film formation when extruding steel melts has been aluminum.

The extension of the capability for producing filaments directly from the melt to metals like steel constitutes an important advance in the art. However, commercial scale practice of this potentially attractive method for producing steel wire has been inhibited by an inability to control the tendency for the orifice to plug during extrusion. Oxidation reactions occurring in the melt prior to extrusion are largely responsible for the partial or complete plugging of the orifice. Contributing to this problem has been a premature oxidation of the second metal used to stabilize the molten stream of steel. As has been noted, aluminum is commonly used for this purpose, and it has not been found practical to maintain the melt oxygen content at the very low levels required for avoiding a premature precipitation of alumina and complexes thereof with the oxides of other metal impurities. Such precipitates form solid inclusions in the melt which accumulate in the orifice area and tend to plug it. Likewise, a similar problem exists with other metals heretofore proposed for alloying with steel to provide a stabilization capability.

It is therefore a principal object of this invention to provide a means for extruding a steel alloy melt to form fine diameter wire in the absence of orifice plugging caused by insoluble oxide formation above the extrusion orifice.

It is another object of this invention to provide a means for controlling the oxygen potential of the melt upstream from the extrusion orifice during the extrusion of molten steel to prevent the occurrence of orifice plugging.

Other objects and advantages will become apparent from a description of the invention which follows:

SUMMARY

The above objects are achieved when steel alloy melts are extruded in accordance with a procedure which includes: (1) employing a melt of steel alloyed with titanium, with the titanium being present in an amount of at least 0.2 percent by weight of the alloy; (2) maintaining a pressurized gas mixture over the melt consisting of an inert gas and an oxygen containing gas; (3) controlling the oxygen potential of the melt upstream from the extrusion orifice at a level wherein the titania within the melt has an activity of from 0.3 to unity — such control being effected by maintaining the partial pressure of the oxygen containing gas at an appropriate predetermined value; (4) extruding the melt as a molten filamentary stream directly into an oxygen-containing medium of sufficient oxidizing capacity to cause titania to precipitate and form a stabilizing film about the surface of the stream; and (5) cooling the film stabilized stream to the solid state.

DESCRIPTION

As above noted, the method of this invention is directed to the production of fine diameter wire from a steel alloy by melt extrusion. For purposes of definition, fine diameter wire may be considered as any wire having a diameter of less than about 35 mils. It is well known, of course, that steel is an alloy of iron and carbon. Generally, the carbon content will be in the range of from about 0.01 to 4.30 by weight of the alloy in steels intended for use in the production of wire products.

According to this invention, steels of the type just described are alloyed with titanium to provide a film-forming component for the melt extrusion procedure. Generally, the titanium concentration will range from between about 0.2 and 5.0 percent on the total weight of the alloy, although there is no process criticality with respect to the upper limit. That is, the upper limit may be determined merely on the basis of the physical characteristics desired in the ultimate product. However, it does appear desirable that the titanium be present in the alloy in an amount of at least 0.2 percent by weight in order to form a stabilizing film of the required strength.

The temperatures employed when extruding the melt are critical only to the extent that they obviously must be at or above the melting point of the alloy. Although not required, it is generally good practice to keep the temperature 10°–20°C. above the liquidus temperature of the alloy during extrusion to provide a margin for any heat loss which might occur. Likewise, the head pressures employed are critical only to the extent that they must impart a sufficient stream velocity to form an efficient jet in accordance with the parameters as set forth in U.S. Pat. No. 3,658,979.

In the film stabilization of inviscid steel jets according to this invention, the viscous film is generated by oxidation of the titanium added to the steel expressly for that purpose. This is brought about by extruding the titanium-containing molten jet directly into an oxidizing medium. Thus, as the jet emerges from the extrusion orifice it is immediately contacted with an oxidizing atmosphere and a film of titania is caused to form almost instantaneously.

It has now been found that when carrying out melt extrusion operations in accordance with the procedure as outlined above, the formation of orifice-plugging inclusions can be greatly reduced by maintaining the activity of titania in the molten mass above the orifice at values between 0.3 and unity. The standard state of unit activity for the purposes of this invention is defined as the melt saturated in titania at the concentration of titanium and oxygen therein and at the temperature of the melt.

The activity of titania within the melt is controlled by means of an oxygen-containing gas which is introduced into the system with an inert gas to provide a positive gas pressure for effecting extrusion. That is, the partial pressure of the oxygen-containing gas in the gas mixture provides the mechanism for this control. The appropriate partial pressure for any given run will, of course, depend upon the particular gas employed, the carbon and titanium concentrations within the melt and the melt temperature. With these parameters being known for any contemplated operation, those skilled in the art can readily calculate the particular partial pressure values which are needed to accomplish the desired result.

Among the oxygen-containing gases which may be employed are carbon monoxide, carbon dioxide, oxygen and steam with carbon monoxide having particular advantages in practice. However, since the purpose of the gas is to function merely as an oxygen donor to the melt chemistry, the choice of an oxygen-containing gas is essentially without limitation. Any suitable inert gas may be employed as the second component in the pressurized gas mixture. For example, argon and helium are commonly employed.

As previously noted, the oxygen content in the melt above the orifice should be controlled at a level which will insure a titania activity of from 0.3 to unity. Generally, best results are realized when the oxygen level in the melt is at or relatively near saturation with respect to titania and the value of the titania activity is from about 0.9 to unity. The reason for this is that the ease of stabilizing titanium-containing steel jets as they emerge from the extrusion orifice is determined by the amount of oxygen dissolved in the molten jet. Hence, a titanium-containing steel melt which is saturated or substantially saturated with oxygen, vis-a-vis titania, is stabilized with greater facility than one which is highly under-saturated in relation to titania.

As previously noted, film stabilization is brought about by extruding the titanium-containing molten jet directly into a gaseous medium having a sufficient oxidizing capacity for causing titania to precipitate and form a film about the peripheral surface of the jet. Although an oxidizing atmosphere rich in carbon monoxide is generally preferred, any oxygen-containing gas or gas mixture having sufficient oxygen potential for effecting titania formation in the molten stream may be employed. In addition to carbon monoxide other suitable examples which may be mentioned are carbon dioxide, oxygen, sulfur dioxide and steam. For purposes of illustration only, the film stabilization chemistry will be described in terms of a carbon monoxide oxidizing medium. It will be understood that other oxygen-containing gases could likewise be employed. The reactions which occur may be set forth as follows:

1. the absorption of gaseous carbon monoxide ($CO_{(g)}$) by the liquid jet to give dissolved carbon ($\underline{C}$) and oxygen ($\underline{O}$).

$$2CO_{(g)} \rightleftharpoons 2\underline{C} + 2\underline{O}$$

followed by;

2. the reaction of titanium in the liquid steel with dissolved oxygen to form a solid titania ($TiO_{2(s)}$) film $$2\underline{O} + \underline{Ti} \rightleftharpoons TiO_{2(s)} + 2\underline{C}.$$

The overall reaction is, thus, the sum of reactions (1) and (2).

3. $2CO_{(g)} + \underline{Ti} \rightleftharpoons TiO_{2(s)} + 2\underline{C}$.

For the stabilizing film of solid titania to form, it is necessary that the solubility limit of oxygen on the steel jet surface be exceeded with respect to titania. This is brought about by exceeding the equilibrium partial pressure of carbon monoxide in the oxidizing atmosphere into which the steel jet is extruded. The total carbon monoxide pressure required for stabilization may be defined as follows:

$$P_{CO}^{***} = P_{CO}^{*} + P_{CO}^{**}$$

where $P_{CO}^{***}$ is the total CO partial pressure required for stabilization, $P_{CO}^{*}$ is the equilibrium partial pressure, and $P_{CO}^{**}$ is the driving force required to form a sufficient strong stabilizing film within the required time limit.

It is seen from the above discussion that orifice plugging is avoided and a proper stabilization of the extruded jet is achieved by an ability to control the oxygen content within the steel-titanium melt at the desired level both above and below the extrusion orifice. That is, before the steel passes through the orifice the activity of titania in the steel melt is controlled to a value of between 0.3 to unity, with from 0.9 to unity generally preferred. As soon as the melt exits from the orifice as a filamentary jet, the oxygen level is increased and a film of precipitated titania is thereby formed before varicose breakup of the molten jet can take place.

As a final step in the production of fine diameter steel wire in accordance with this invention, the film stabilized molten stream or jet is passed into a cooling medium to effect solidification. It is desirable to utilize a gas with good thermal conductivity for this purpose. That is, gases such as helium, hydrogen, carbon dioxide, nitrogen or mixtures thereof may be suitably employed with hydrogen and helium or mixtures of hydrogen and nitrogen being of particular preference.

For a description of a representative type apparatus which may be employed for producing fine diameter wire in accordance with this invention, attention is directed to the drawing wherein the single FIGURE depicts a schematic, partially sectionalized, vertical view of an induction heated extrusion apparatus.

As shown there, such apparatus is comprised of a crucible 2 having a base plate 3, the crucible and base plate being supported on pedestal 4 and enclosed within an insulating cylinder 5 and a susceptor 6 employed in conjunction with induction heating coils 7. The unit is pressurized by gases brought into the head 9 through conduit 8. Sealing rings 10 serve to maintain the pressure within the enclosure by preventing leakage past the base plate. The molten metal 1 is forced through orifice 11 in orifice plate 12 by the gaseous head pressure and emerges from orifice 11 as a cylindrical molten jet 13. The nascent jet passes through an oxygen-containing gaseous atmosphere contained within cavity 14 provided by the pedestal 4. The oxygen-containing gas is brought into cavity 14 via conduit 15.

It is to be understood that the just-described extrusion apparatus is merely a schematic representation of a typical assembly which may be employed in the practice of the present invention. Many design variations are possible and will readily occur to those skilled in the art. For example, all or part of the pressurizing gas mixture could be introduced into the system by providing a means for bubbling the gases up through the melt as an alternative or supplementary means to the introduction above the melt surface as shown in the drawing. The important consideration is that the oxygen-containing gas be provided to the system at the proper partial pressure. Moreover, a resistance-heated assembly could be substituted for the illustration induction-heated unit. The following illustrative example will serve to further amplify the invention.

EXAMPLE

A steel alloy made from electrolytic iron alloyed with 0.4 percent by weight of carbon and 1.0 percent by weight of electrolytic titanium was melted at a temperature of 1550°C., and the temperature was thereafter decreased to 1540°C. and held at this level. Under a 9.0 psig head pressure provided by a mixture of argon and carbon monoxide gases, the melt was ejected through a 10 mil orifice and thence into a mixture of carbon monoxide and helium. During streaming, the partial pressure of the carbon monoxide above the melt was maintained at approximately 0.2 atmospheres (the equilibrium value for the oxygen-titanium-carbon reaction within the melt). As the molten stream exited from the orifice, this equilibrium value was caused to be exceeded by the partial pressure of carbon monoxide in the gaseous atmosphere (i.e. a mixture of carbon monoxide and helium) immediately below the orifice. As a consequence, titania precipitated and formed an enveloping film about the periphery of the extruded stream. The film-stabilized stream then passed through a gas cooled tube where it solidified in the form of a fine diameter steel wire. An orifice plugging or erosion problem was not encountered during the extrusion.

While there has been described what presently are considered to be the preferred embodiments of this invention, it will be apparent to those skilled in the art that various changes and modifications may be made without departing from the invention. It is to be understood, therefore, that the invention is limited only by a proper construction of the language in the claims which follow.

I claim:

1. In a method for producing fine diameter wire from the melt of a steel alloy wherein said melt is extruded through an orifice as a continuous molten stream and into an oxygen-containing atmosphere where a stabilizing film is caused to form about the surface of the stream to preserve its continuity until solidified, the improvement which comprises:

a. heating to the melt an alloy comprised of steel and at least 0.2 percent by weight of titanium;

b. maintaining a pressurized gas mixture over the melt consisting of an inert gas and an oxygen-containing gas;

c. controlling the oxygen potential of the melt by means of said oxygen-containing gas at a level wherein the titania formed in the melt by oxidization of said titanium has an activity of from about 0.3 to unity;

d. causing said melt to extrude through an orifice as a continuous molten stream and into an oxygen-containing gaseous atmosphere having the capacity for increasing the oxygen potential of said stream to a level wherein said titania is caused to precipitate and form a stabilizing film about the periphery of said stream;

e. cooling said film-stabilized molten stream to the solid state.

2. The method of claim 1, wherein said steel-titanium melt contains from about 0.01 to 4.3 percent by weight of carbon and from about 0.2 to 5.0 percent by weight of titanium.

3. The method of claim 1, wherein said gas mixture over the melt consists of an inert gas and a gas selected from the group consisting of carbon monoxide, carbon dioxide, oxygen and steam.

4. The method of claim 3, wherein said inert gas is argon.

5. The method of claim 1, wherein said melt is extruded as a molten stream into a gaseous atmosphere selected from the group consisting of carbon monoxide, carbon dioxide, oxygen, sulfur dioxide and steam.

6. The method of claim 1, wherein the oxygen containing gas in the gas mixture over the melt is carbon monoxide and the melt is extruded as a molten stream into a carbon monoxide containing atmosphere.

7. The method of claim 1, wherein the oxygen potential of the melt is controlled to where the activity of titania is from 0.9 to unity.

8. The method of claim 1, wherein hydrogen or helium are employed as a cooling gas to cool said film-stabilized molten stream to the solid state.

* * * * *